US006125590A

United States Patent [19]

Dionne

[11] Patent Number: 6,125,590

[45] Date of Patent: Oct. 3, 2000

[54] WINDOW BALANCE BIASING DEVICE

[76] Inventor: Kenneth R. Dionne, 29 N. Amherst Rd., Bedford, N.H. 03110

[21] Appl. No.: 09/351,950

[22] Filed: Jul. 12, 1999

[51] Int. Cl.[7] ..... E05D 13/00

[52] U.S. Cl. ..... 49/453

[58] Field of Search ..... 49/453, 50, 55, 49/57, 507; 248/188.5, 354.5

[56] References Cited

U.S. PATENT DOCUMENTS 1,891,588 12/1932 Claus ..... 49/55 X 5,201,488 4/1993 Hadbavny ..... 248/354.5

*Primary Examiner*—Jerry Redman

*Attorney, Agent, or Firm*—Davis and Bujold

[57] ABSTRACT

A window balance biasing device including an outer tubular member telescopically receiving an inner tubular member. The inner tubular member and the outer tubular member are movable relative to one another to adjust the axial length of the window balance device. A pair of spring biased detents are supported within the inner tubular member and the spring biased detents are engageable with a desired pair of apertures provided in the outer tubular member to facilitate a locking engagement therebetween and thereby facilitate locking of the inner tubular member and the outer tubular member at a desired axial length. The free ends of both the inner and outer tubular members support a window balance engagement member. During use, the window balance biasing device is adjusted to an axial length which is slightly longer than the spacing between a pair of opposed balance such that when the window balancing device is forced into a substantially horizontal position, the pair of opposed window balances are biased away from one another to facilitate pivoting of the window from an in use substantially vertical orientation to a substantially horizontal cleaning orientation and vice versa once the cleaning operation is complete. In a preferred form, at least one of the window engagement balancing members is slidably engageable with one of window balances.

20 Claims, 6 Drawing Sheets

WINDOW BALANCE BIASING DEVICE

FIELD OF THE INVENTION

The present invention relates to a device for prying or biasing a pair of opposed window balances apart from one another to facilitate pivoting of a pivotable window from a vertical, in use position to a substantially horizontal position, to aid with cleaning of the window, and also, if desire, to facilitate pivoting the window back to a vertical, in use position once the window is suitably clean.

BACKGROUND OF THE INVENTION

There are a variety of commonly known windows which include features or devices permitting the pivoting of the window from a substantially vertical orientation to a substantially horizontal orientation, to facilitate cleaning thereof, and back to a substantially vertical orientation. Nevertheless, there are not any currently available devices which facilitate maneuvering of a window, equipped with a pivoting device or feature, to its substantially horizontal orientation, to facilitate cleaning thereof, and back to its substantially vertical orientation following cleaning.

In particular, modern windows generally include a pair of balances, provided along opposed inwardly facing vertical surfaces of the window frame which have a spacing from one another that is slightly smaller than the width of window to be supported therebetween. The side surfaces of the window each have a groove formed therein which is designed to receive one of the opposed balances and facilitate sliding movement of the window relative to the balances. The window also carries, along each opposed bottom edge portion thereof, a pivot which is received within a track extending along each of the associated balances thus enabling the window to be pivotally maneuvered from a substantially vertical orientation to a substantially horizontal orientation, and vice versa, to facilitate cleaning while still permanently retaining the bottom edge portion of the window aligned with the window balances. The pair of balances normally engage with the grooves and sandwiching the window therebetween in its typical vertical orientation.

Although the windows are typically pivotally retained along their bottom edge portions, it is the sandwiching force or bias of the opposed pair of balances located along the vertical edges of the window frame which securely holds each window in its typical vertical orientation. However, such sandwiching force or bias also renders it difficult for an operator to at least partially free the window from the pair of balances and easily pivot the window, when desired, from its vertical orientation to its substantially horizontal orientation and vice versa for cleaning and/or removal purposes. Such pivoting movement is further hindered due to the fact that the pair of balances must tightly engage with the window to provide a weatherproof sealing engagement therebetween.

SUMMARY OF THE INVENTION

Wherefore, it is the object of the present invention to overcome the above noted drawbacks of the prior art.

A further object of the present invention is to provide a device which is easily employed by an operator to facilitate pivoting of a window from a substantially vertical, in use position to a substantially horizontal position, to aid with cleaning and/or removal of the window, and also assists with pivoting the window, if desired, back to its vertical orientation.

Another object of the invention is to provide a device which has a variable length to facilitate use of the device with a window having a variety of shapes and sizes.

Still another object of the invention is to provide a device which is relatively inexpensive to manufacture and is relatively easy and safe to utilize.

The invention relates to a window balance biasing device for biasing at least one opposed pair of window balances away from one another, said window balance biasing device comprising: a first elongate member supporting a first window balance engagement member adjacent a first end thereof; a second elongate member supporting a second window balance engagement member adjacent a first end thereof; a second end of the first elongate member being engageable with a second end of the second elongate member to facilitate a length adjustment of said window balance biasing device; and a locking mechanism for facilitating a releasable locking engagement between the first and second elongate members when in a desired adjusted length.

The invention relates to a method of biasing at least one opposed pair of window balances away from one another with a window balance biasing device, the method comprising the steps of: supporting a first window balance engagement member adjacent a first end of a first elongate member; supporting a second window balance engagement member adjacent a first end of a second elongate member; engaging a second end of the first elongate member with a second end of the second elongate member to facilitate a length adjustment of said window balance biasing device; providing a locking mechanism for facilitating a releasable locking engagement between the first and second elongate members when in a desired adjusted length; adjusting to a length of the window balance biasing device to a length slightly longer than a spacing of a desired pair of opposed window balances; and separating the desired pair of opposed window balances from one another via positioning the window balance biasing device therebetween.

BRIEF DESCRIPTION OF THE DRAWINGS

The invention will now describe, by way of example, with reference to the accompanying drawings, in which.

DESCRIPTION OF THE PREFERRED EMBODIMENTS

While this invention is susceptible to various embodiments, the specification and the accompanying drawings disclose only one specific form as an example of the invention. For ease of description, the window balance biasing device, embodying this invention, is described in its normal operating position, and terms such as upper, lower, vertical, horizontal, etc., are used with reference to this position. It will be understood, however, that the window balance biasing device and components embodying this invention may be manufactured, stored, transported, used, and sold in an orientation other than the position described.

Figure 1:
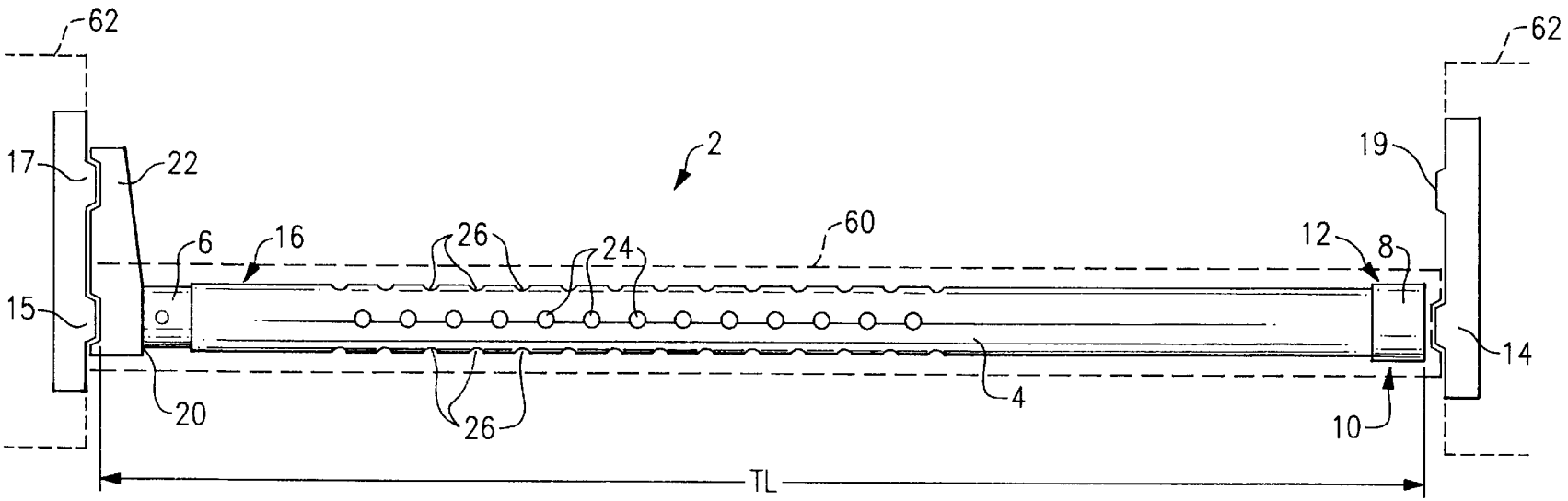
FIG. 1 is a diagrammatic perspective view of the window balance device according to the present invention.

Turning now to FIGS. 1 through 12, a detail description concerning the present invention will now be provided. With reference first to FIGS. 1–5, the window balance device 2, according to the present invention, generally comprises an outer tubular member 4 which telescopically receives an inner tubular member 6. A conventional rubber end cap 8 is frictionally attached to a first end 10 of the outer tubular member 4 and the rubber end cap 8 functions as a fixed balance engaging member 12 and facilitates a frictionally secure engagement of the first end 10 of the window balance device 2 with one of the opposed pair of window balances, e.g. the window balance 14 on the right as can be seen in FIG. 1.

Figure 5:
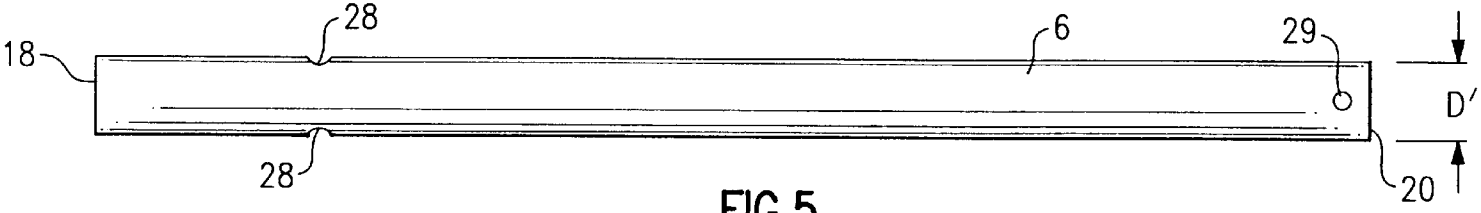
FIG. 5 is a diagrammatic perspective view of the inner tubular member according to the present invention.
Figure 6:
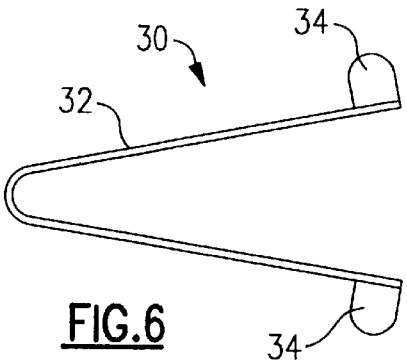
FIG. 6 is a diagrammatic front elevational view of a detent mechanism incorporated within one end of the inner tubular member.

The other second end 16 of the outer tubular member 4 telescopically receives a first end 18 of the inner tubular member 6 (FIG. 5). An opposed second end 20 of the inner tubular member 6 receives the second slidable balance engaging member 22 which slidably engages with the other pair of window balances 15 and 17, e.g. the two window balance on the left as can be seen in FIG. 1.

Figure 4:
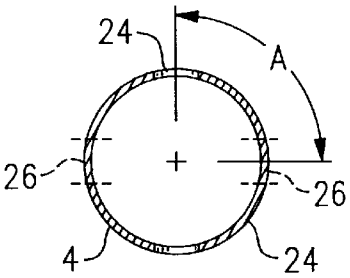
FIG. 4 is a cross-sectional view of the outer tubular member along section line 4—4 of FIG. 3.
Figure 3:
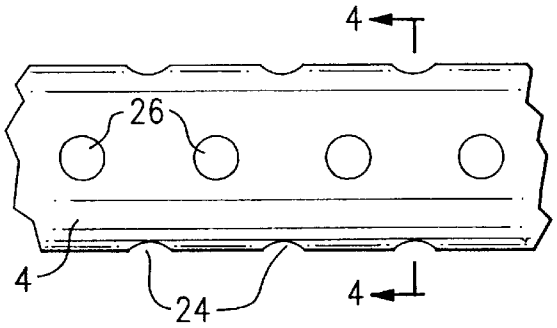
FIG. 3 is a partial diagrammatic view of the outer tubular member of FIG. 2.
Figure 2:
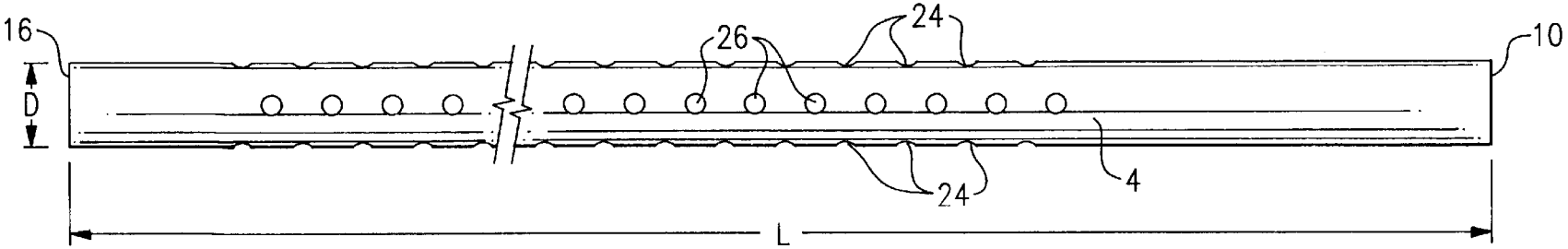
FIG. 2 is a diagrammatic perspective view of the outer tubular member.

With reference now to FIGS. 2–4, a detailed description concerning the outer tubular member 4 will now be provided. As can be seen in FIG. 2, the outer tubular member 4 is generally cylindrical in shape and has an outer diameter D of about 1 inch or so and an inner diameter of about 0.925 inches. It is to be appreciated that the shape and/or the diameter of the tubular member can vary, from application to application, depending upon the specific requirements. The outer tubular member typically has a length L of between about 10 inches to about 50 inches, more preferably a length of about 15 inches to about 30 inches and most preferably has a length of either about 17 inches or about 23.5 inches.

The outer tubular member 4 is provided with a first series of opposed mating pairs of apertures 24 and a second series of opposed mating pairs of apertures 26 formed along a substantial portion thereof. Each aperture 24 or 26 has a diameter or dimension of about ⅜ inch or so and is located opposite another mating aperture 24 or 26. The apertures forming both the first series and the second series of opposed mating pairs of apertures 24 and 26 are spaced about ¾ inch or so apart from one another and a pair of mating apertures 24 of the first series is located between each pair of mating apertures 26 of the second series. The first series of opposed mating pairs of apertures 24 are aligned and oriented at an angle A of about 90° with respect to the second plurality of opposed mating pairs of apertures 26, as detailed in FIGS. 3 and 4. It is to be appreciated that the total number apertures, the size of the apertures, the spacing of the apertures along the surface of the outer tubular member, etc., can vary from application to application, depending upon the overall size and/or length of the tubular member 4, as will be apparent to those skilled in the art. A variable length for the outer tubular member 4 is depicted in FIG. 2.

With reference now to FIG. 5, a detailed description concerning the inner tubular member 6 will now be provided. The inner tubular member is a generally cylindrical member which has an outer diameter D' of about 0.87 inch, or so. The inner tubular member is sized to have a sliding fit relative to the inner dimension of the outer tubular member to facilitate relatively uninhibited and unrestricted sliding movement of the inner tubular member 6 within the outer tubular member 4. A pair of opposed detent apertures 28 are provided in the first end of the inner cylindrical member 6 while a pair of securing apertures 29 are provided in the opposite end of the inner cylindrical member 6. The inner tubular membertypically has a length L of between about 10 inches to about 50 inches, more preferably a length of about 15 inches to about 30 inches and most preferably has a length of either about 15 inches or about 25 inches.

Prior to insertion of the inner tubular member 6 into the outer tubular member 4, a spring biased detent mechanism 30 (FIG. 6), e.g. a V-shaped leaf spring 32 supporting a generally cylindrical shaped detent 34 at each free end of the leaf spring, is compressed and placed inside the inner tubular member 6. The spring biased detent 30 is received within the first end 18 of the inner tubular member 6 such that the cylindrical shaped detents 34 extend partially through the pair of opposed detent apertures 28 provided in the first end 18 of the inner cylindrical member 6. Due to this arrangement, the leaf spring 32 biases each cylindrical detent 34 partial through one of the apertures 28, provided in the inner tubular member 6, to facilitate locking engagement with a desired mating pair of apertures 24 or 26 provided in the outer tubular member 4, and a further detailed description concerning such engagement will be provided below. The pair of securing apertures 29 facilitates secure attachment of the slidable balance engaging member 22 thereto, and a further detailed description concerning such attachment will be provided below.

Figure 9:
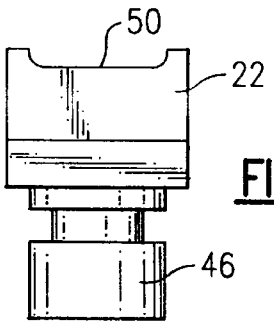
FIG. 9 is a right side elevational view of the slidable balance engaging member of FIG. 7.
Figure 8:
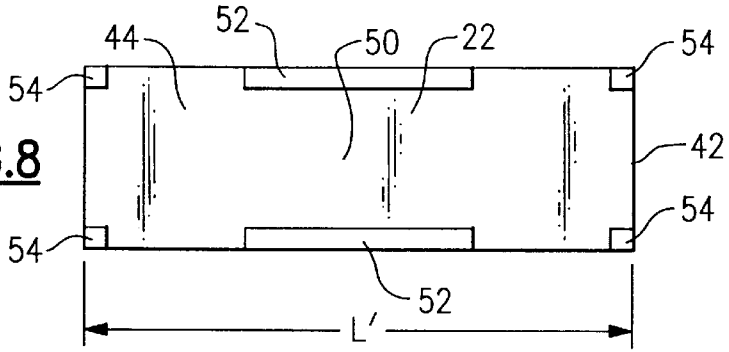
FIG. 8 is a diagrammatic top plan view of the slidable balance engaging member of FIG. 7.
Figure 7:
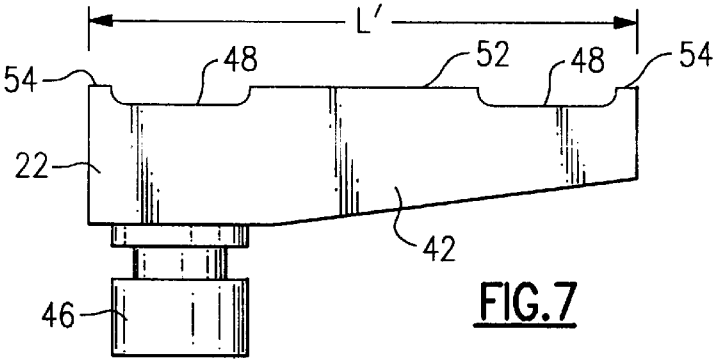
FIG. 7 is a diagrammatic front elevational view of a slidable balance engaging member according to the present invention.

With reference to FIGS. 7–9, a detailed description concerning the slidable balance engaging member 22 will now be provided. As can be seen in FIGS. 7 and 8, the slidable balance member 22 generally comprises an elongate rectangular shape member 42 having a balance engaging surface 44. The opposite end of the balance engaging member 22 is provided with a cylindrical post or section 46 which is shaped and sized to be received within the second end 20 of the hollow inner tubular member 6 and secured thereto via the pair of securing apertures 29. A pin, screw, rivet, locking ring or some other conventional fastener, which facilitates attachment of the slidable balance member 22 to the second end of the inner tubular member 6, may be utilized. In addition, a variety of other conventional known attachment mechanisms can be utilized to facilitate secure attachment of the slidable balance member 22 to the second end 20 of the inner tubular member 6. As such teaching is conventional and well known in the art, a further detailed description concerning the same is not provided.

A side wall 52 of the slidable balance member 22, as can be seen in FIG. 7, is provided with a pair of contoured transverse recesses 48 which are each shaped to matingly receive and facilitate alignment of the slidable balance member 22 with respect to a pair of adjacent window balances, 15, 17 or 14, 19. In addition, each opposed end wall 54 of the slidable balance member 22 is provided with an elongate balance recess 50, as seen in FIGS. 8 and 9, which extends along the entire length of the slidable balance member 22 perpendicular to and across the two transverse recesses 48. The elongate balance engaging recess 50 facilitate engagement of only a single balance 15 or 17, for example, of a window via the slidable balance member 22, and a further detailed description concerning the same will follow. As noted above, the transverse recesses 48 and the elongate balance engaging recess 50 are each defined by the balance engaging surface 44, a pair of opposed side walls 52 and a pair of opposed end walls 54. The slidable balance member 22 typically has a maximum length dimension of about 3.0 inches or less.

Figure 10:
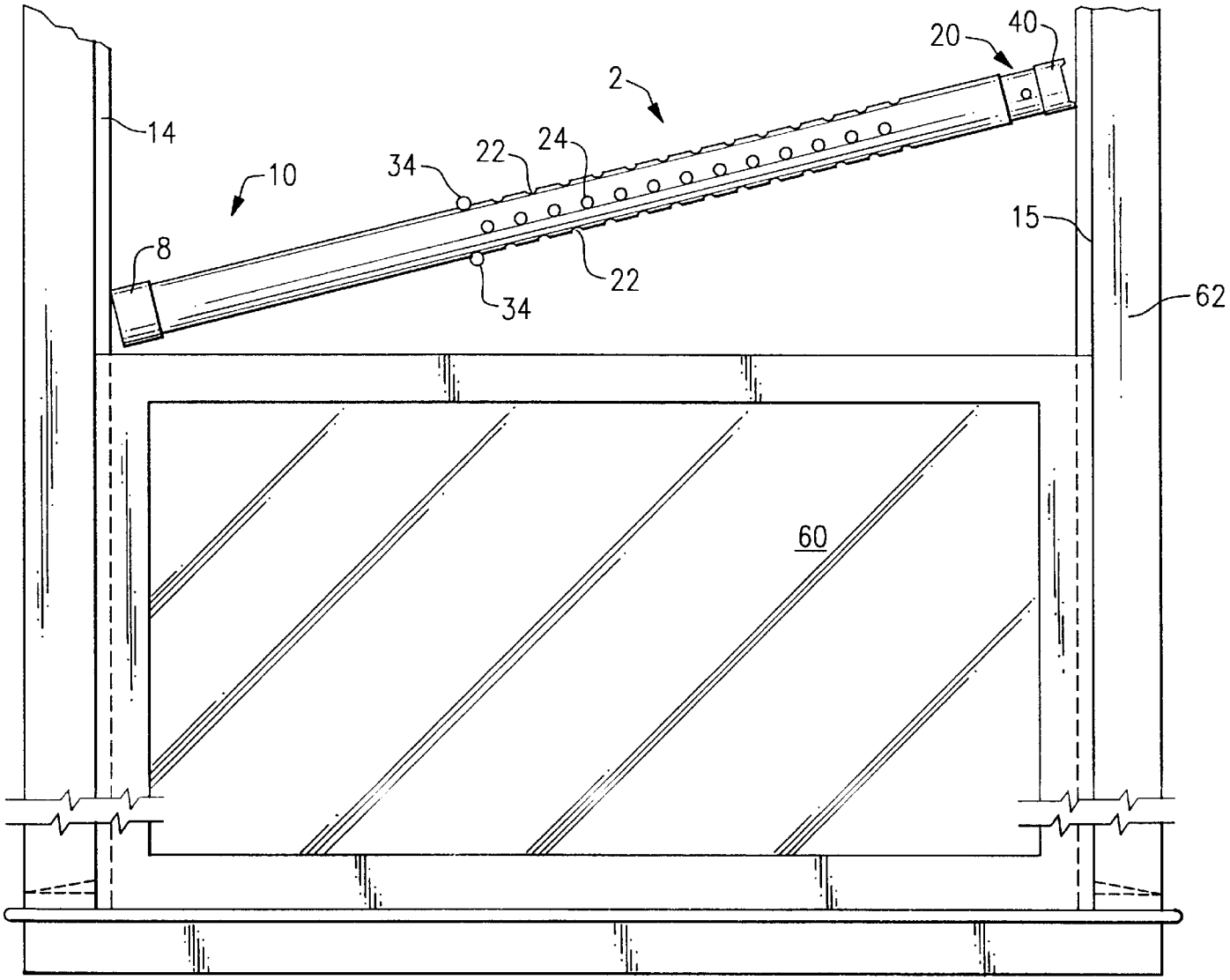
FIG. 10 is a diagrammatic perspective view of the window balance device, according to the present invention, shown in its install ready for use position.
Figure 11:
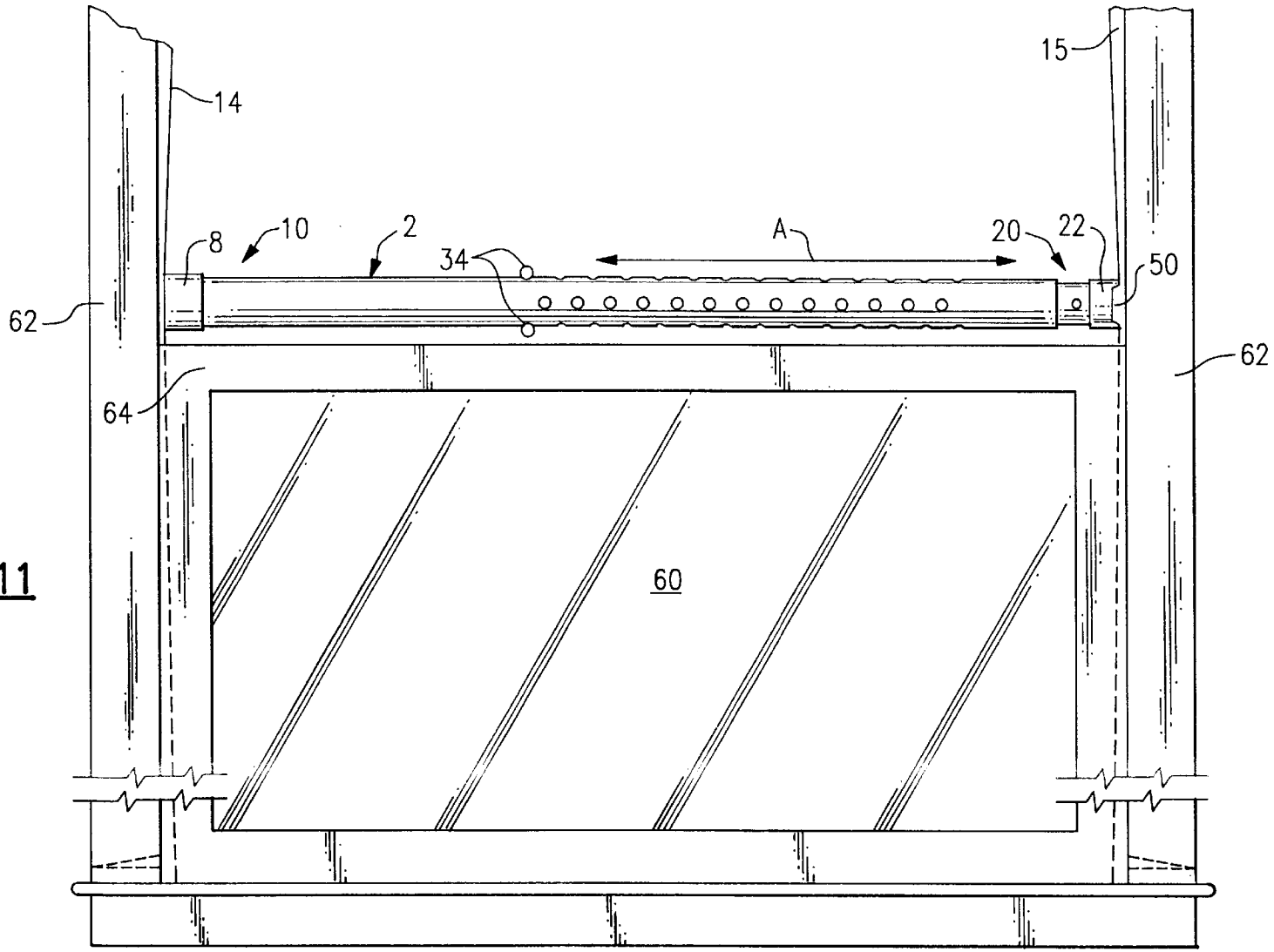
FIG. 11 is a diagrammatic perspective view of the window balance device, according to the present invention, shown in its use position biasing the pair of opposed balances away from one another.

Now that a description concerning the various components of the window balance device 2, according to the present invention, has been provided, a detailed description concerning the use of the same, with reference to FIGS. 10 and 11, will now be given. When an operator desires to use the window balance device 2, according to the present invention, the operator will carry the device to a desired window. As shown in FIG. 10, the operator will then place the first end 10 of the window balance device 2 against a desired window balance, e.g. window balance 14, with the first end 10 of the window balance device being centered with respect to the desired window balance 14 and an end face of the rubber cap 8 providing a frictional engagement therewith. The operator then pinches or squeezes the cylindrical detent members 34 inwardly, toward one another, to release the locking engagement and facilitate sliding movement of the inner tubular member 6 relative to the outer tubular member 4. The operator will adjust the length of the inner tubular member 6 relative to the outer tubular member 4 until the total adjusted length TL of the window balance device 2 (FIG. 1), from the outwardly facing end face of the rubber cap 8 to the outwardly facing balance engaging surface 44, is slightly larger than the interior, e.g. the total adjusted length of the window balance device 2 will be approximately ¼ inch to ½ inch or so wider than the spacing of the opposed window balances 14 and 15 or 17 and 19.

Once the inner tubular member 6 is suitably adjusted, the operator will allow the spring biased cylindrical detents 34 to again project through a desired opposed pair of apertures 24 or 26 provided in the outer tubular member 4 to lock the inner tubular member 6 relative to the outer tubular member 4. With the proper adjustment made to the window balance device 2, such that the device is preferably of a slightly greater width than the spacing between opposed window balances 14 and 15 or 17 and 19, the operator, placing his/her left hand, for example, adjacent the first end of the window balances device 2 and placing his/her right hand adjacent the opposing second end 20 of the window balances device 2, manipulates or slides the second end 20 downwardly along the window balance 15 toward a substantially horizontally orientation, as seen in FIG. 11. As can be understood from the drawings, the window balance device 2 is necessarily held at an angle (FIG. 10) an angle of about 5 to 20 degrees or so from horizontal (FIG. 11) due to its width being somewhat greater than that of the space between the opposed window balances 14 and 15 and/or 17 and 19.

The rubber end cap 8 of the first end 10, carried by the outer tubular member, is securely abutted against and centered with respect to one of the balances 14, 15, 17 or 19 of the window frame 62 and is located adjacent an edge portion of the window 60 to be pivoted. The window balance device 2 is generally initially placed in an area between the two opposing pairs of balance 14, 16 and 17, 19 at an acute angle from the horizontal such that no pressure is exerted against the opposed balances. The operator, holding the end 10 fast against the associated balance with the hand closest thereto, uses the opposite hand to exert a generally downward, or possibly upward, pressure on second end 20 to bring the balance device 2 into horizontal alignment proximate the non-pivoted free end 64 of the window to be pivoted. In doing so, a substantial outward biasing force, in the direct of arrows A (FIG. 11), is exerted on the opposing balances 14, 16 and 17, 19 thus substantially relieving or minimizing, at the very least, the sandwiching force on the window 60 tending to maintain the window in its substantially vertical orientation, as shown in FIG. 11.

The window balance device 2 is thus moved to a substantially horizontal position. During such movement of the window balance device 2, the second balance engaging member 22 is lowered to its maximum biasing position with the opposed window balances 14, 16 and 17, 19. As the window balance biasing device 2 has a total adjusted length TL which is ¼ inch to ½ inch or so wider than the width or spacing between the opposed pair of window balances 14, 16 and 17, 19, the opposed pairs of window balance 14, 16 and 17, 19 are biased away from one another by a distance of between ¼ inch to ½ inch or so, depending upon the actual total length of the window balance biasing device 2.

Such biasing action spaces at least a central portion of the window balances 14, 16 and 17, 19 away from one another and allows at least the non pivoted free end 64 of the pivoted window to be readily pivoted from a substantially vertical in use orientation to a substantially horizontal orientation to assist with cleaning of the window 60.

It is to be appreciated that the window balance biasing device 2 may remain in its substantially horizontal orientation until the window 60 is sufficiently cleaned and then the window 60 may thereafter be pivoted back to its substantially vertical orientation so as to be slidable along the opposed pair of window balances 14, 16 and 17, 19. If desired, the window balance biasing device 2 can be completely removed from its engagement with the window balances 14, 16 and 17, 19, once the window 60 is pivoted to a substantially horizontal cleaning position, as the window can be readily returned back to its original substantially vertical orientation without use of the window balance biasing device 2 according to the present invention.

As can be seen in FIG. 1, at least the second balance engaging member 22 is provided with a pair of transverse recesses 48, and each recess is shaped to engage with one of the front and rear window balances 15 and 17 or 14 and 19, respectively. Due to this arrangement, both the front and rear window balances 15 and 17 or 14 and 19 are engaged and pried or biased apart from one another to facilitate pivoting of both the "top" and "bottom" windows, when both the top and bottom windows are position centrally with respect to the top and the bottom of the window frame, through use of a single window balance biasing device 2, according to the present invention. Alternatively, if a window frame is only provided with one window balance, or if, for some reason, there is not adequate space for the entire window balance biasing device 2, the second balance engaging member 22 can be rotated 90°, from the position shown in FIG. 1, so that the longitudinal recess 50 of the second balance engaging member 40 is aligned along a single window balance, either balance 15 or balance 17, to facilitate spacing apart of only a single opposed pair of window balances 14 and 15 or 17 and 19.

Figure 12:
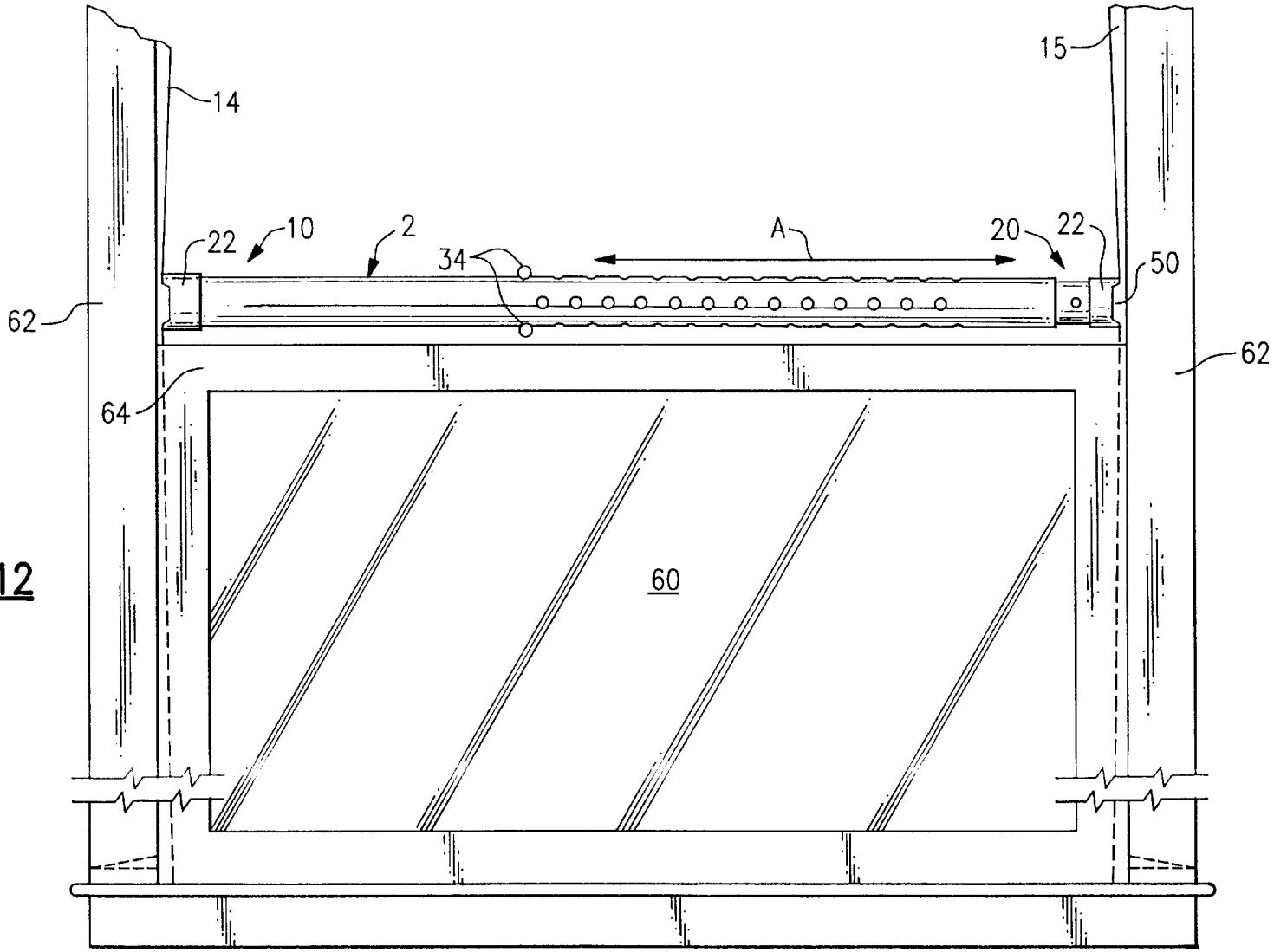
FIG. 12 is a diagrammatic perspective view of a second embodiment of the window balance device, according to the present invention, shown in its use position biasing the pair of opposed balances away from one another.

It is to be appreciated that the rubber end cap 10 can, if so desired, be replaced with a the second window balance member substantially identical to that shown in FIGS. 7–9, so that both window balance engaging members are identical to one another. This embodiment is shown in FIG. 12, for example.

Although the opposed cylindrical detent members 34 are disclosed as being biased via a V-shaped leaf spring, it is to be appreciated that other conventional and well known spring means and/or biasing arrangements can be employed to bias the detent members through the mating apertures 24, 26 and 28 provided in the outer and inner tubular members 4, 6 while still permanently retaining the detent members 34 within the inner tubular member 6.

It is to be appreciated that a variety of other coupling arrangements can be employed for connecting either the first or second window balance engagement members with the respective outer and inner tubular members 4, 6. For example, either one or both of the first window balance engagement members 8, 22 can be rotatably coupled to the respective ends of the outer and inner tubular members 4, 6 to facilitate rotation thereof.

The window balances biasing device, according to the present invention, typically has a minimum length of about 15 inches or so and a maximum length of about 50 inches or so and more preferably has a minimum length of about 24 inches and a maximum length of about 40 inches or so.

Since certain changes may be made in the above described window balance biasing device, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A window balance biasing device biasing at least one opposed pair of window balances away from one another, said window balance biasing device comprising:

a first elongate member supporting a first window balance engagement member adjacent a first end thereof;

a second elongate member supporting a second window balance engagement member adjacent a first end thereof;

a second end of the first elongate member being engageable with a second end of the second elongate member to facilitate a length adjustment of said window balance biasing device; and a locking mechanism for facilitating a releasable locking engagement between the first and second elongate members when in a desired adjusted length;

wherein said second window balance engagement member is an elongate member which is provided with two spaced apart transverse recesses, and each one of said transverse recesses is shaped to accommodate a desired window balance.

2. The window balance biasing device according to claim 1, wherein said first elongate member comprises a substantially hollow outer tubular member, and said second elongate member comprises an inner tubular member and said inner tubular member is telescopically received within said outer tubular member.

3. The window balance biasing device according to claim 2, wherein said inner tubular member supports said locking member adjacent the second end thereof, and said outer tubular member is provided with a plurality of apertures, in an exterior surface thereof, along the second end thereof to facilitate the releaseable locking engagement with the locking mechanism carried by said second end of said inner tubular member.

4. The window balance biasing device according to claim 3, wherein said locking member comprises a pair of opposed detents which project partially through a pair of apertures provided in said second end of said inner tubular member, and the pair of detents are biased away from one another by a spring.

5. The window balance biasing device according to claim 4, wherein the exterior surface of said outer tubular member is provided with a plurality of apertures, spaced axially along an exterior surface of said outer tubular member, to facilitate length adjustment of said window balance biasing device.

6. The window balance biasing device according to claim 5, wherein a first series of opposed pairs of equally spaced apart apertures are provided along the exterior surface of the outer tubular member, and a second series of opposed pairs of equally spaced apart apertures are also provided along the exterior surface of the outer tubular member, and the first series of opposed pairs of equally spaced apart apertures are located at an angle of about 90° relative to the second series of opposed pairs of equally spaced apart apertures.

7. The window balance biasing device according to claim 1, wherein said window balance biasing device has an axial length which is adjustable from about 17 inches to about 50 inches.

8. The window balance biasing device according to claim 1, wherein said first window balance engagement member is a slip-resistant end cap which is engaged with the first end of said outer tubular member.

9. The window balance biasing device according to claim 1, wherein said second balance engagement member is secured to the first end of the first member.

10. The window balance biasing device according to claim 1, wherein said second window balance engagement member has an elongate balance recess which extends along said second window balance engagement member perpendicular to and across the two spaced apart transverse recesses, and said elongate balance recess is shaped to accommodate a desired window balance.

11. The window balance biasing device according to claim 1, wherein at least one of said first and second window balance engagement members is rotatably coupled to one of said first and second members.

12. The window balance biasing device according to claim 1, wherein both said first and second window balance engagement members are each an elongate member which is provided with two spaced apart transverse recesses, and each one of said transverse recesses is shaped to accommodate a desired window balance.

13. The window balance biasing device according to claim 1, wherein said window balance biasing device has a transverse width which is 3 inches or less.

14. The window balance biasing device according to claim 1, wherein the first elongate member has a diameter of about 1 inch.

15. The window balance biasing device according to claim 1, wherein the outer tubular member has a length of between 10 inches to about 50 inches and the inner tubular member has a length of between about 10 to about 50 inches.

16. A window balance biasing device biasing at least one opposed pair of window balances away from one another, said window balance biasing device comprising:

a first elongate member supporting a first window balance engagement member adjacent a first end thereof;

a second elongate member supporting a second window balance engagement member adjacent a first end thereof;

a second end of the first elongate member being engageable with a second end of the second elongate member to facilitate a length adjustment of said window balance biasing device; and a locking mechanism for facilitating a releasable locking engagement between the first and second elongate members when in a desired adjusted length;

wherein a first series of opposed pairs of equally spaced apart apertures are provided along the exterior surface of the first elongate member, and a second series of opposed pairs of equally spaced apart apertures are also provided along the exterior surface of the second elongate member, and the first series of opposed pairs of equally spaced apart apertures are located at an angle of about 90° relative to the second series of opposed pairs of equally spaced apart apertures.

17. The window balance biasing device according to claim 16, wherein each of the first series and second series of opposed pairs of equally spaced apart apertures have diameters of about ⅜ of an inch.

18. The window balance biasing device according to claim 16, wherein the apertures of the first series of opposed pairs of equally spaced apart apertures are spaced about ¾ of an inch, for one another and the apertures of the second series of opposed pairs of equally spaced apart apertures are spaced about ¾ of an inch from one another.

19. A window balance biasing device biasing at least one opposed pair of window balances away from one another, said window balance biasing device comprising:

a first elongate member supporting a first window balance engagement member adjacent a first end thereof;

a second elongate member supporting a second window balance engagement member adjacent a first end thereof;

a second end of the first elongate member being engageable with a second end of the second elongate member to facilitate a length adjustment of said window balance biasing device; and a locking mechanism for facilitating a releasable locking engagement between the first and second elongate members when in a desired adjusted length;

wherein both said first and second window balance engagement members are each an elongate member which is provided with two spaced apart transverse recesses, and each one of said transverse recesses is shaped to accommodate a desired window balance.

20. The window balance biasing device according to claim 19, wherein each of said first and said second window balance engagement members has an elongate balance recess which extends along said second window balance engagement member perpendicular to and across the two spaced apart transverse recesses, and each said elongate balance recess is shaped to accommodate a desired window balance.

* * * * *